US005628511A

United States Patent [19]

Jacoby

[11] Patent Number: 5,628,511

[45] Date of Patent: May 13, 1997

[54] TABULAR REFERENCE BOOK FOR PLAYING BLACKJACK

[76] Inventor: Albert A. Jacoby, 6568 Via Regina, Boca Raton, Fla. 33433

[21] Appl. No.: 452,348

[22] Filed: May 26, 1995

[51] Int. Cl.[6] ..... A63C 1/06; G09B 19/22

[52] U.S. Cl. ..... 273/148 R; 283/32; 283/42; 434/129

[58] Field of Search ..... 273/148 R, 292, 273/302, 274; 434/129, 317; 283/36, 37, 38, 41, 42, 43, 129, 32, 115, 117; 281/23

[56] References Cited

U.S. PATENT DOCUMENTS

| | | | |
|---|---|---|---|
| 3,924,340 | 12/1975 | Tammone | 273/148 R |
| 4,027,884 | 6/1977 | Oakley | 273/148 R |
| 4,652,014 | 3/1987 | Maher | 283/42 |
| 4,715,621 | 12/1987 | Colauito et al. | 283/36 |
| 4,778,183 | 10/1988 | Luisi | 273/148 R |
| 4,863,194 | 9/1989 | Friedman | 283/38 |
| 5,056,824 | 10/1991 | Olson | 283/36 |
| 5,100,326 | 3/1992 | Leep et al. | 434/129 |
| 5,358,280 | 10/1994 | Scales | 283/42 |

FOREIGN PATENT DOCUMENTS

| | | | |
|---|---|---|---|
| 1196661 | 11/1985 | Canada | 273/148 R |

OTHER PUBLICATIONS

Casino Strategy Cards by Pocketec of Margate, N.J.

Blackjack Master by Idea Bank Company Las Vegas, Nev.

Playing Blackjack as a Business by Paul Mann Publishing Co., of Las Vegas, Nev.

Casino 21 Basic Strategy Calculator by Thornton and Associates.

Flash Jack by Blue Bear Press of Solana Beach, CA 92075.

*Primary Examiner*—William M. Pierce

*Attorney, Agent, or Firm*—Oltman, Flynn & Kubler

[57] ABSTRACT

An apparatus is provided for recommending plays in the game of blackjack including a sheet having a sheet first face and a sheet second face, a dealer up card symbol printed on the sheet identifying a possible dealer up card, a player hand column of player hand symbols printed on the sheet first face corresponding to possible player card hands, and a recommended play column printed on the sheet first face beside the player hand column and containing symbols indicating recommended plays for a player to make corresponding to each player hand symbol in the player hand column for the particular dealer up card printed on the sheet. The apparatus preferably includes several of these sheets, where the sheets have differing dealer up card symbols for various possible dealer up cards. The sheets are preferably arranged in sequential order of dealer up card values indicated by the dealer up card symbols. The sheets each preferably include a sheet binding edge and a sheet opposing free edge and the apparatus preferably additionally includes a binder, where the binder engages the sheet binding edges to thereby retain the sheets together in the form of a book.

6 Claims, 21 Drawing Sheets

TABULAR REFERENCE BOOK FOR PLAYING BLACKJACK

BACKGROUND OF THE INVENTION

1. Field of the Invention

The present invention relates generally to the field of card game assistance devices and methods. More specifically the present invention relates to a play recommendation apparatus and system for the game of blackjack. The inventive apparatus includes a sheet having printed on it a symbol identifying a possible dealer up card and a player hand column of player hand symbols corresponding to possible player card hands. Juxtaposed with the player hand column is a play column containing play symbols indicating the recommended play for the player to make corresponding to each player hand symbol in the player hand column, given the value of the dealer up card indicated on the sheet. The player hand column preferably includes a column heading such as "You Have".

Several such sheets are preferably provided, one for each of several possible dealer up cards, and are joined together with a binder in dealer up card numerical sequence to form a conveniently sized book. The binder is preferably a spiral binder so that the book opens to any selected sheet with minimal resistance and stays open. Each sheet is preferably divided into sheet halves separated by the binder, so that half of each column extends vertically down one sheet half and the other half column extends down the facing sheet half. The backs of the sheets are preferably the fronts of other sheets for compactness and efficiency. The player hand column is preferably in card value numerical order and preferably color coded, so that hard hands are one color, soft hands another color, and doubles still another color for rapid and convenient access to play information. An index tab is preferably provided for each sheet, each tab displaying the dealer up card value marked on the particular sheet from which it extends.

Alternatively the sheets may include only the single dealer up card symbol and the play column. A book cover or back sheet somewhat wider than the rest of the sheets is provided. Since the player hand column is normally constant from sheet to sheet, it is printed only on portions of the book cover or back sheets inner surfaces extending beyond the other sheet edges to align and correspond with adjacent recommended play symbols on each and every open sheet.

The recommended plays displayed in the play column are preferably based upon statistics of maximum success for a player. Alternatively the recommended plays may be based upon personal experience or other factors.

A system is provided of playing the game of blackjack using the above described apparatus. The system includes the steps of noting the value of the dealer up card, opening the book to the given sheet displaying the corresponding up card symbol, noting the value of the given player hand, locating the given player hand symbol in the player hand column corresponding to the value of the given player hand, noting the particular play symbol adjacent to the given hand symbol, and making a play corresponding to the particular play symbol.

2. Description of the Prior Art

There have long been blackjack playing aids for guiding players in deciding when to stand, hit, double or split. One such prior device is marketed by Blue Bear Press under the name FLASHJACK™, and is a card having a table printed on it. The table includes a series of adjacent vertical columns headed by dealer up card values and intersecting horizontal columns headed by player hand values. A problem with FLASHJACK™ is that the card values and play symbols are difficult to read. The numbers in the table are necessarily very small to all fit onto the card and there are too many columns too close together. Misreadings and the resulting losing hands could cost a player money.

BLACK JACK STRATEGY™ marketed by POCKETEC™ is a card similar to that of FLASHJACK™, except that summarized play instructions are provided in discrete lines of hand value sets printed on both sides of the card. A problem with BLACK JACK STRATEGY™ is that the player has to think through which set particular dealer up cards and player hand values may fall into during the stress and heat of a game. This can lead to needless and costly play errors.

WIN AT BLACKJACK™ marketed by Paul Mann Publishing Co. includes a card slidably retained within a pocket having a data display slot. The card has printed on it data in the form of lines of play suggestions, each line including a player hand value. These lines of play suggestions are individually displayed through the display slot adjacent a series of possible dealer up card values printed on the pocket adjacent the slot. A problem with WIN AT BLACKJACK™ is that the lines of data have to be printed very small to all fit onto the one card, and are thus difficult to read at a glance. Another problem is that the sliding of the card within the pocket is awkward.

BLACKJACK MASTER™ marketed by Idea Bank Company includes a cardboard first disk rotatably and concentrically mounted on a larger second disk. The first disk has dealer up card values printed around its circumference, and the second disk has player hand value symbols printed around its circumference, adjacent to the dealer up card values. Each dealer up card value has adjacent to it a slot in the first disk. Rotating the disks relative to each other to place a given dealer up card value next to a given player hand value symbol causes a particular color on the second disk to appear in the corresponding slot in the first disk. The color in the slot signals the player whether he or she should hit, stand, double or split. A problem with BLACKJACK MASTER™ is that the player might become confused about the meanings of the color signals or look at the wrong slot, since the slots are necessarily close together. BLACKJACK MASTER™ is complicated to read and use.

CASINO 21 BASIC STRATEGY™ marketed by Thornton and Associates is a cardboard disk rotatably mounted on a rectangular card. The disk has a slot with dealer up card values printed adjacent to it and an arrow printed at a point along its circumference. Printed on the card around the edge of the disk are player hand value symbols. The player rotates the disk to point the arrow to the player hand value symbol corresponding to his or her hand. This causes a line of recommended play symbols printed on the card to appear in the slot, each play symbol being adjacent to a dealer up card value. The player acts on the play recommendation printed next to the current player up card value in the game. A problem with CASINO 21 BASIC STRATEGY is that the disk can easily rotate a few degrees accidently and without the player noticing, so that the wrong play data is displayed. Another problem is that the eye can become confused trying to read the closely grouped play symbols adjacent the closely grouped dealer up card values, again causing improper play decisions.

It is thus an object of the present invention to provide a blackjack play recommendation apparatus which minimizes player confusion under the stress and heat of play by limiting the play recommendations in sight of the player to those corresponding to a given dealer up card value.

It is another object of the present invention to provide such an apparatus which is easy to understand and easy to read.

It is still another object of the present invention to provide such an apparatus which is easy to open to the desired information and is not easily disturbed to reveal inapplicable information.

It is finally an object of the present invention to provide such an apparatus which is compact and inexpensive to manufacture.

SUMMARY OF THE INVENTION

The present invention accomplishes the above-stated objectives, as well as others, as may be determined by a fair reading and interpretation of the entire specification.

An apparatus is provided for recommending plays in the game of blackjack including a sheet having a sheet first face and a sheet second face, a dealer up card symbol printed on the sheet identifying a possible dealer up card, a player hand column of player hand symbols printed on the sheet first face corresponding to possible player card hands, and a recommended play column printed on the sheet first face beside the player hand column and containing symbols indicating recommended plays for a player to make corresponding to each player hand symbol in the player hand column for the particular dealer up card printed on the sheet. The apparatus preferably includes several of these sheets, where the sheets have differing dealer up card symbols for various possible dealer up cards. The sheets are preferably arranged in sequential order of dealer up card values indicated by the dealer up card symbols. The sheets each preferably include a sheet binding edge and a sheet opposing free edge and the apparatus preferably additionally includes a binder, where the binder engages the sheet binding edges to thereby retain the sheets together in the form of a book. The binder is preferably a spiral binder and the sheet binding edges in this instance include perforations for receiving segments of the spiral binder. The sheets are each preferably divided into first and second sheet halves forming pairs of sheet halves, each pair of sheet halves being connected by the binder so that the book opens to display first faces of only one given pair of sheet halves at a time. The play column of a given sheet is preferably divided into first and second play column segments, the first play column segment being printed on the sheet first face of the first sheet half of the given pair of sheet halves, and the second play column segment is printed on the sheet first face of the second sheet half, so that the entire play column of the given sheet is displayed when the book is opened to the given sheet. The dealer up card symbols are preferably printed on sheet first faces and the sheet second faces are preferably printed to become sheet first faces of other sheets, for increased book compactness. The player hand column is preferably color coded, so that hard hands are represented in a first color, soft hands are represented in a second color, and doubles are represented in a third color, for rapid and convenient access to recommended play information. The apparatus preferably additionally includes a tab extending from each sheet, each given tab displaying the given dealer up card symbol marked on the particular sheet from which the given tab extends.

An apparatus is also provided for recommending plays in the game of blackjack, including a cover member having an inner surface and an outer surface, several sheets, each sheet having a sheet first face and a sheet second face, a binder securing the cover member and the sheets together, an up card symbol printed on each sheet identifying a possible dealer up card, the up card symbol and dealer up card identified by the up card symbol varying from sheet to sheet, a recommended play column printed on each sheet and containing recommended play symbols for a player to make, a player hand column of player hand symbols printed on a portion of the cover member inner surface and extending beyond the sheets, beside the player hand column printed on each sheet, the play hand symbols corresponding to and substantially aligning with individual play symbols in the play column on each sheet for the particular dealer up card printed on each sheet.

A system is provided of playing the game of blackjack using the above described apparatus for recommending plays in the game of blackjack, including the steps of noting the value of the dealer up card, opening the book to the given sheet displaying the corresponding up card symbol, noting the value of the given player hand, locating the given player hand symbol in the player hand column corresponding to the value of the given player hand, noting the particular play symbol adjacent to the given hand symbol, and making a play corresponding to the particular play symbol.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
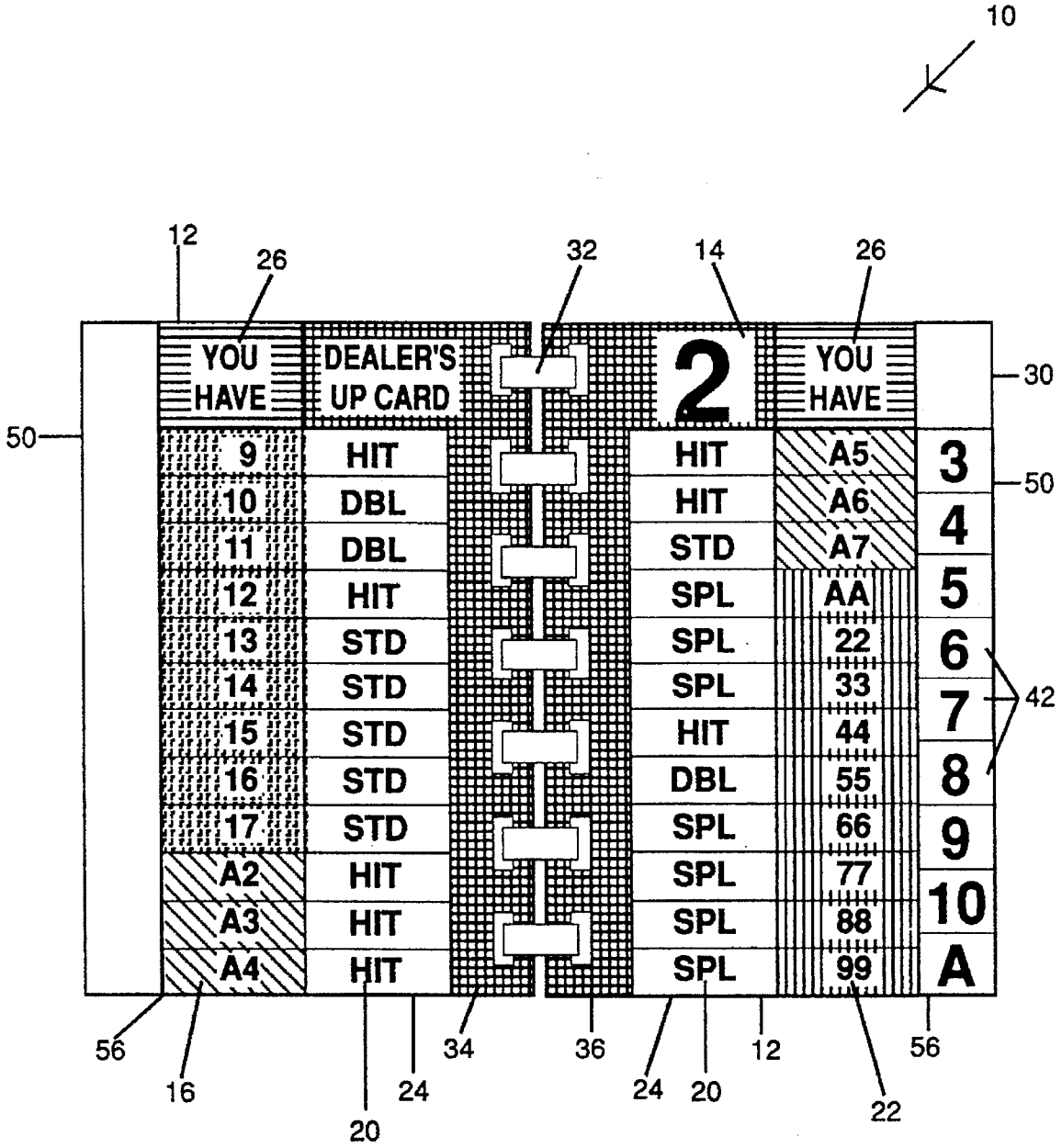
FIGS. 1 and 1*a*–1*i* are examples of the inventive sheets of the first embodiment making up a play recommendation book.
Figure 1A:
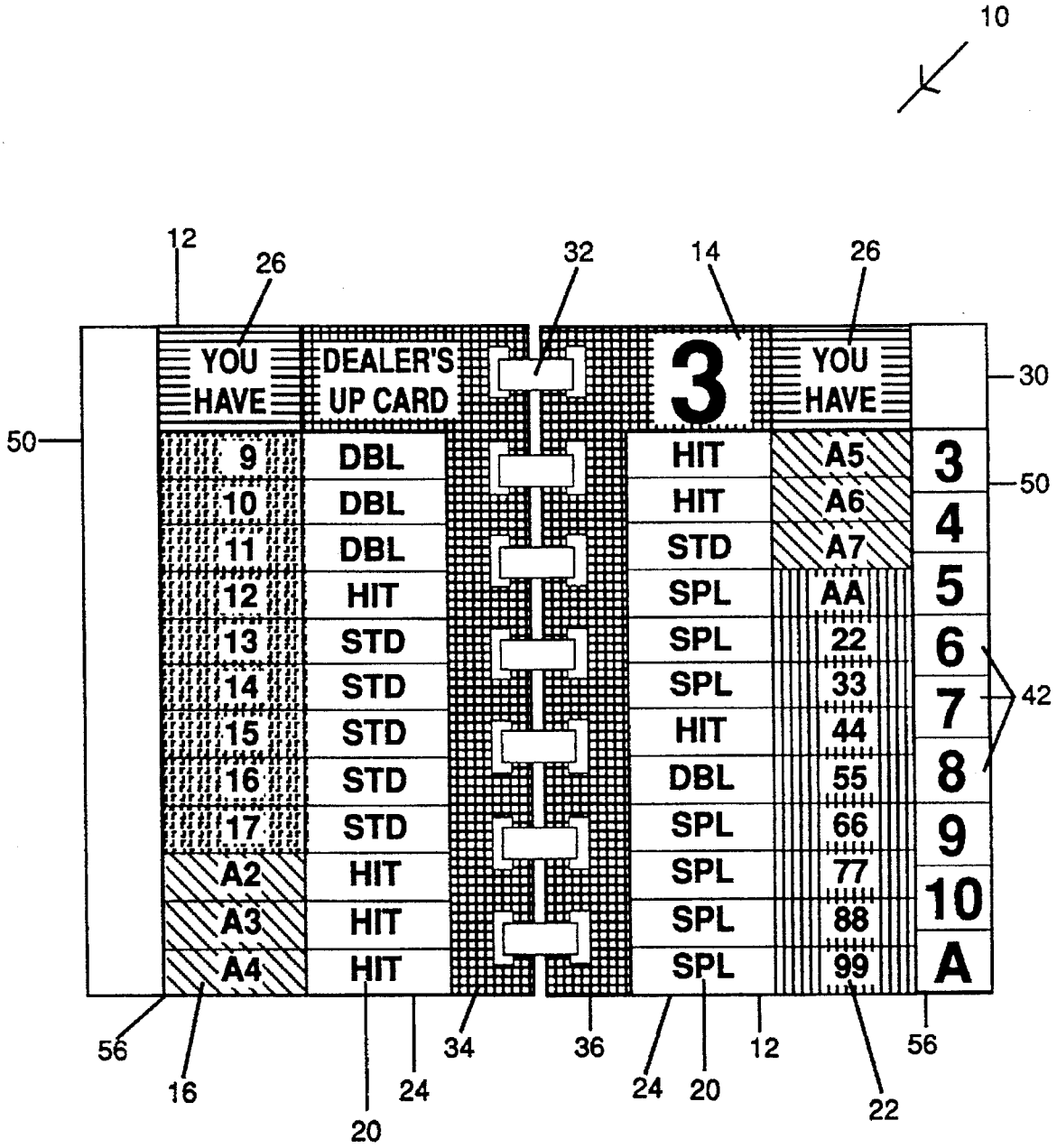
Figure 1B:
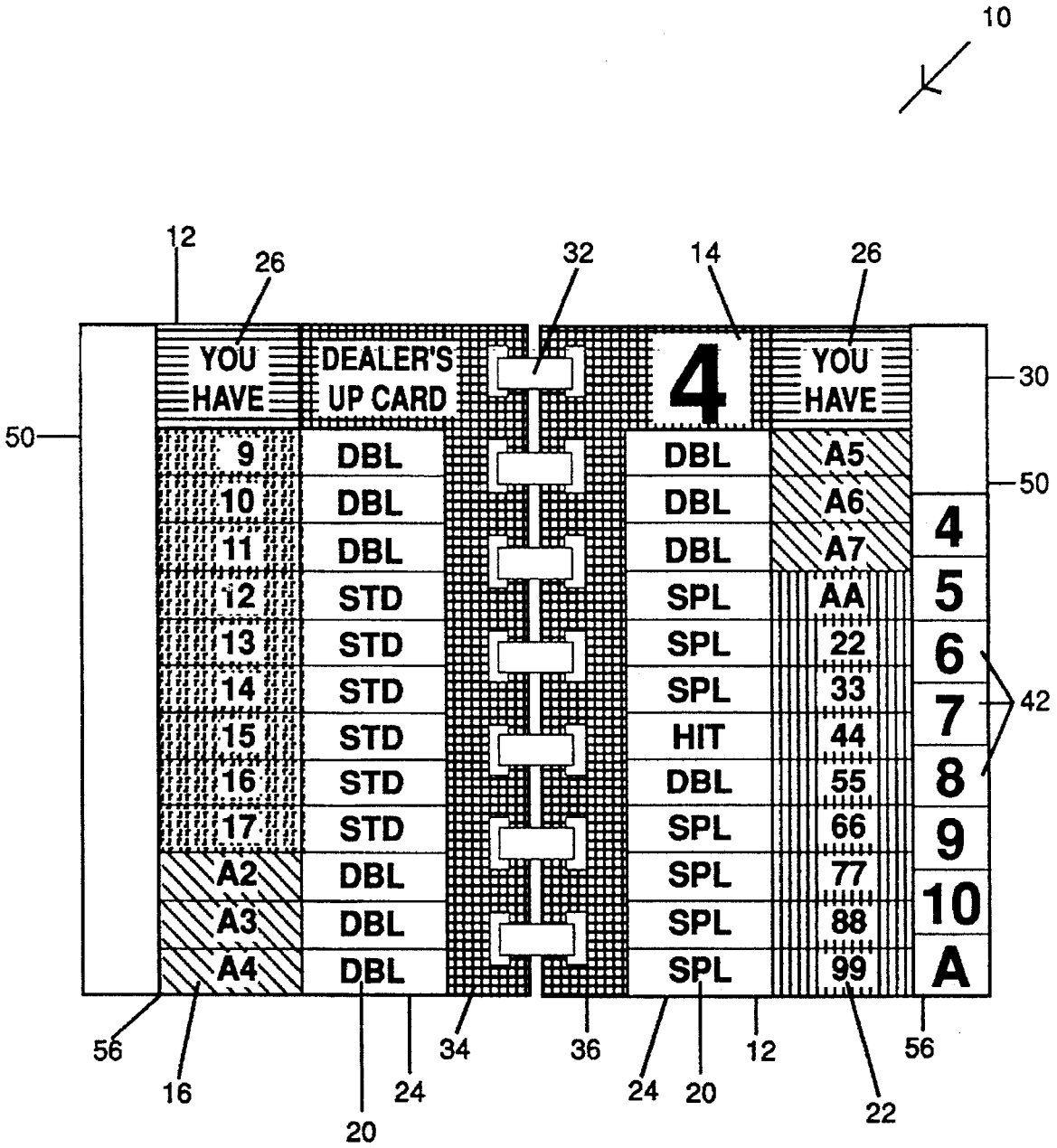
Figure 1C:
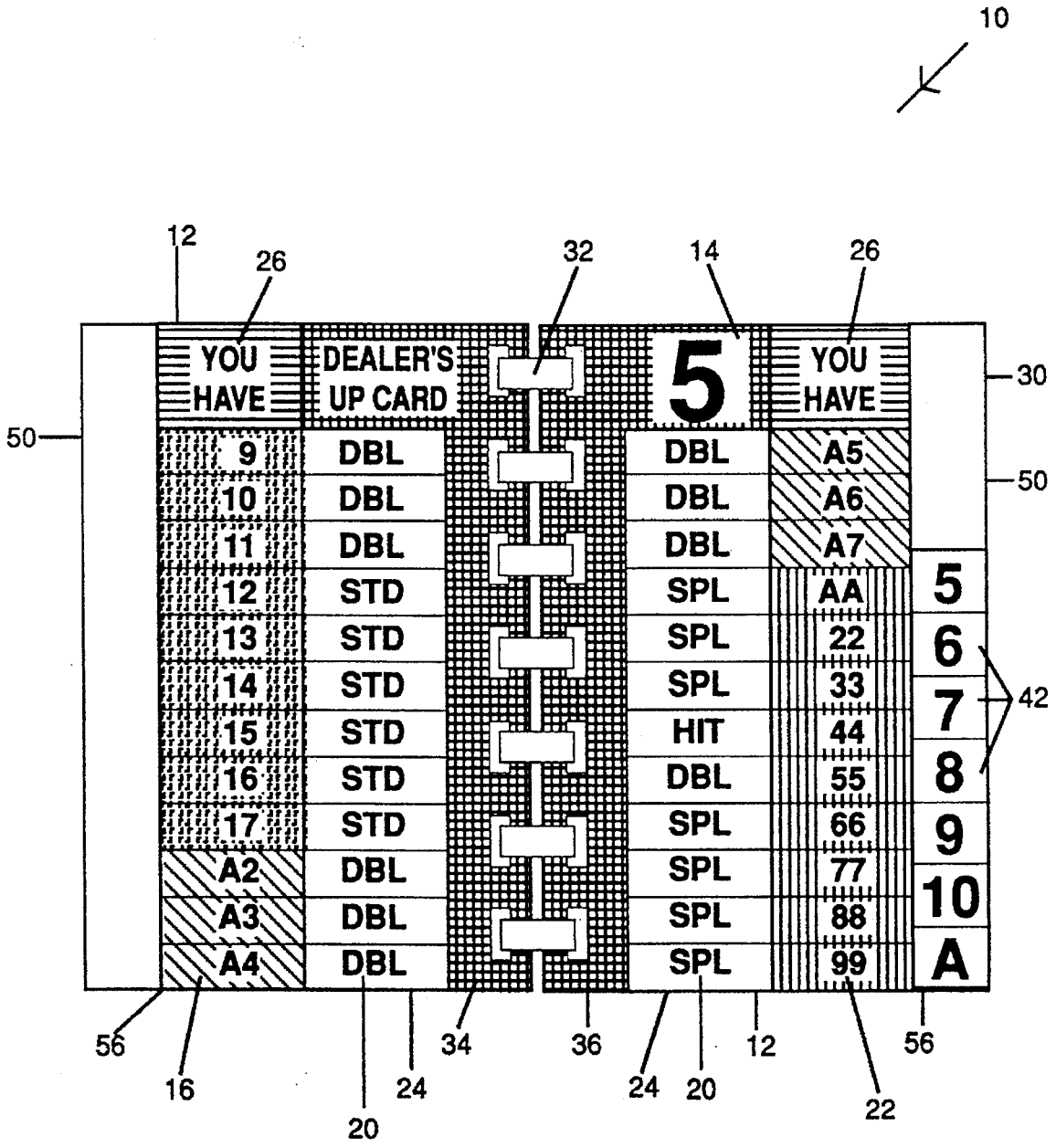
Figure 1D:
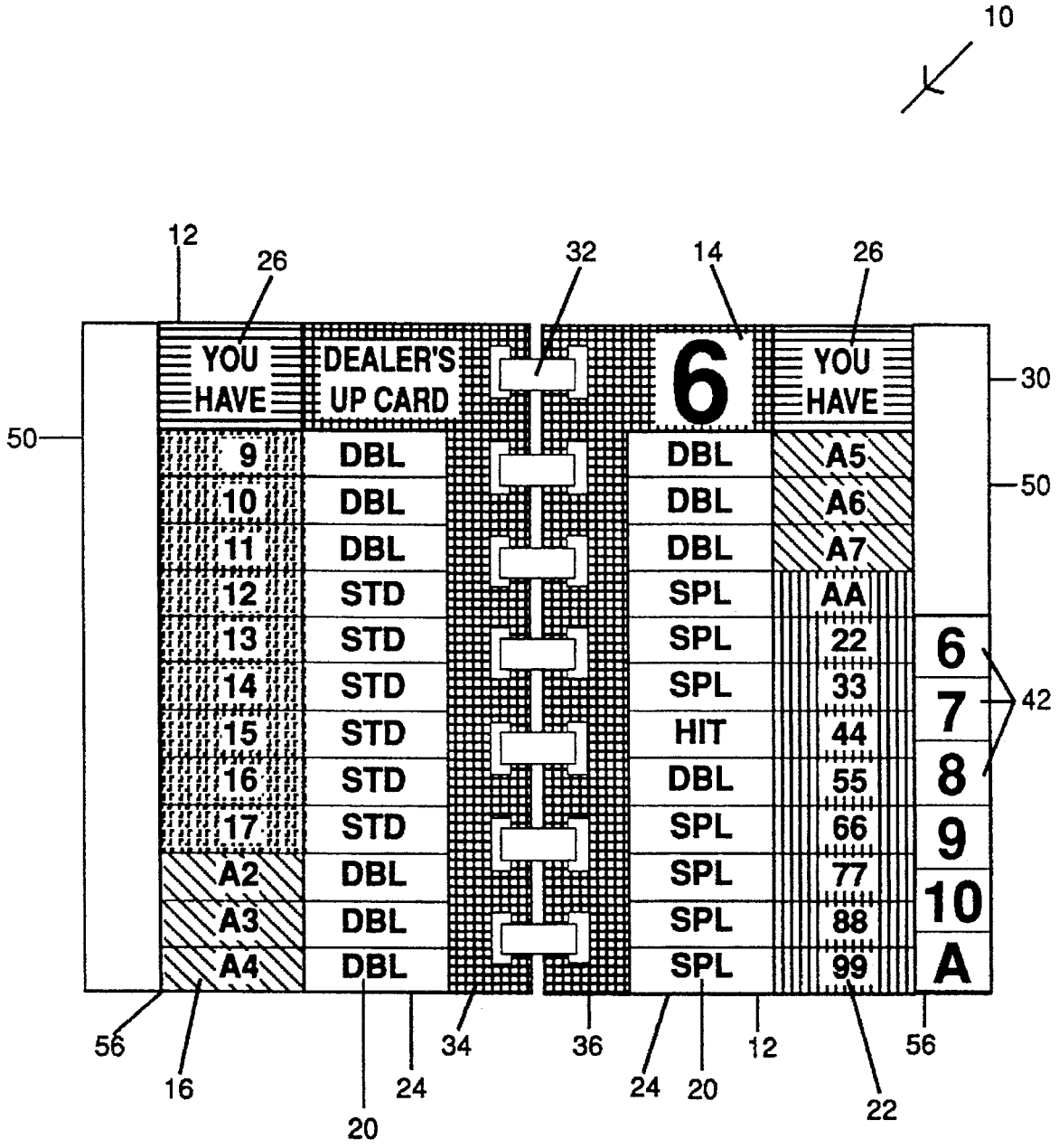
Figure 1E:
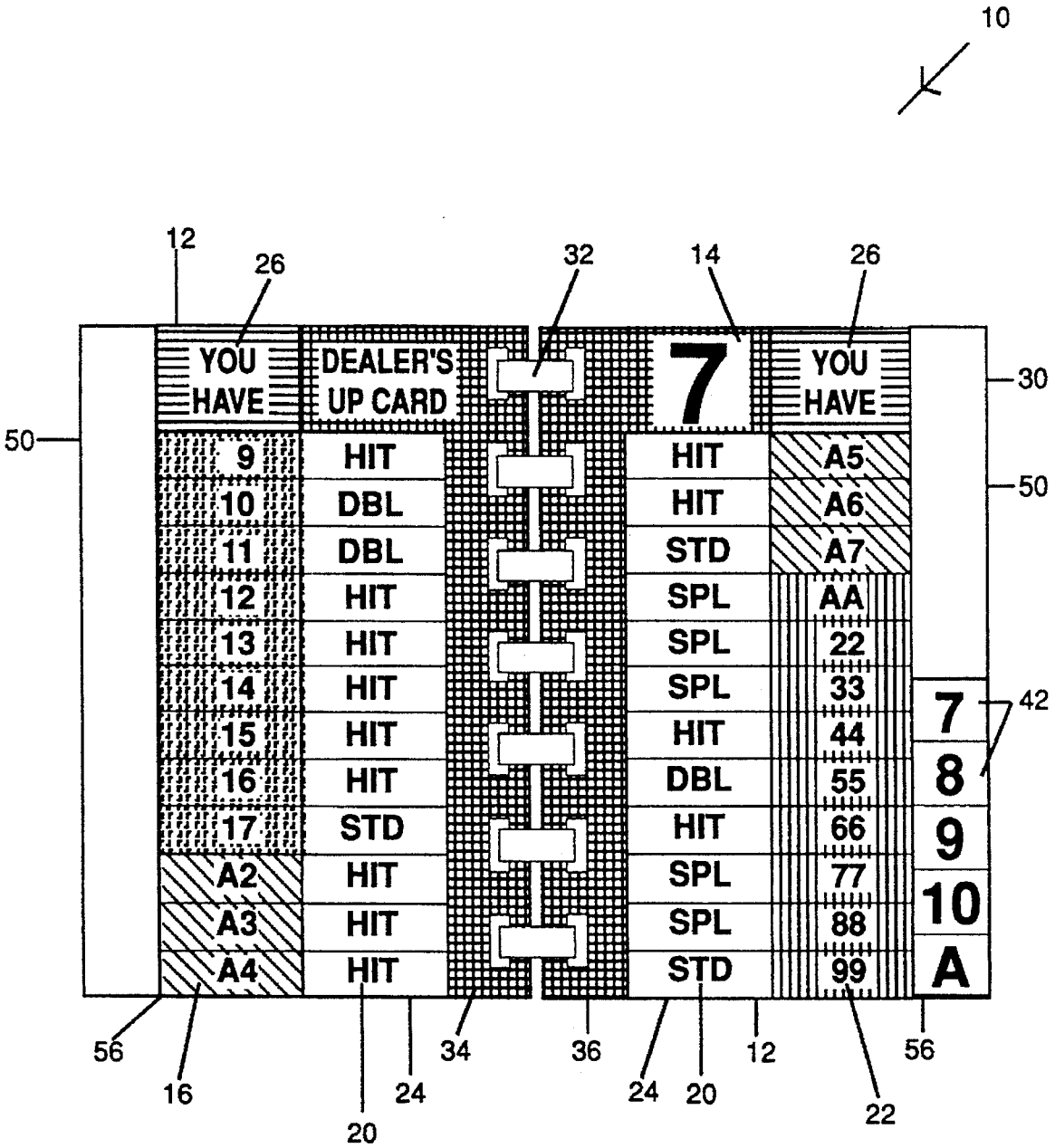
Figure 1F:
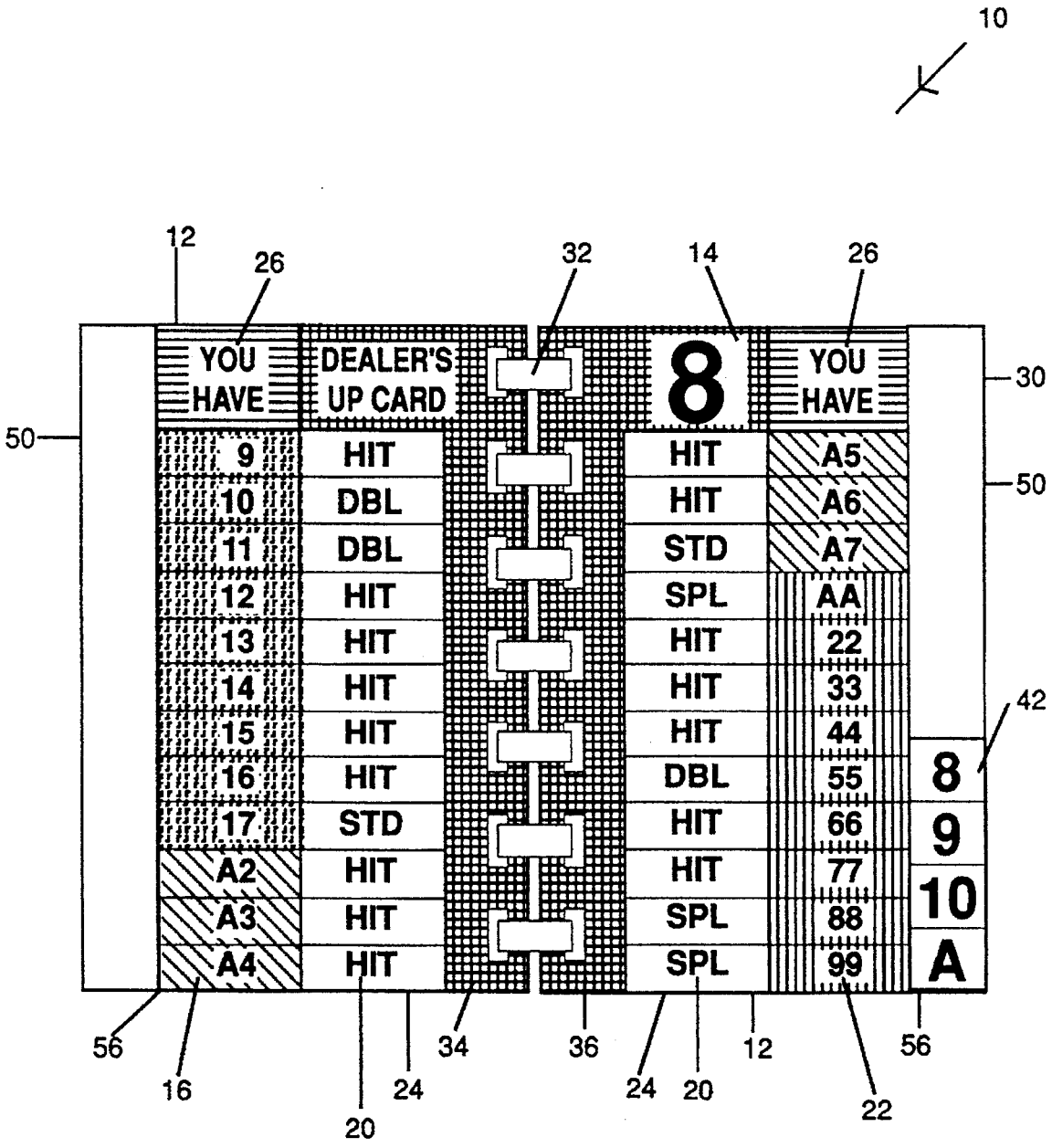
Figure 1G:
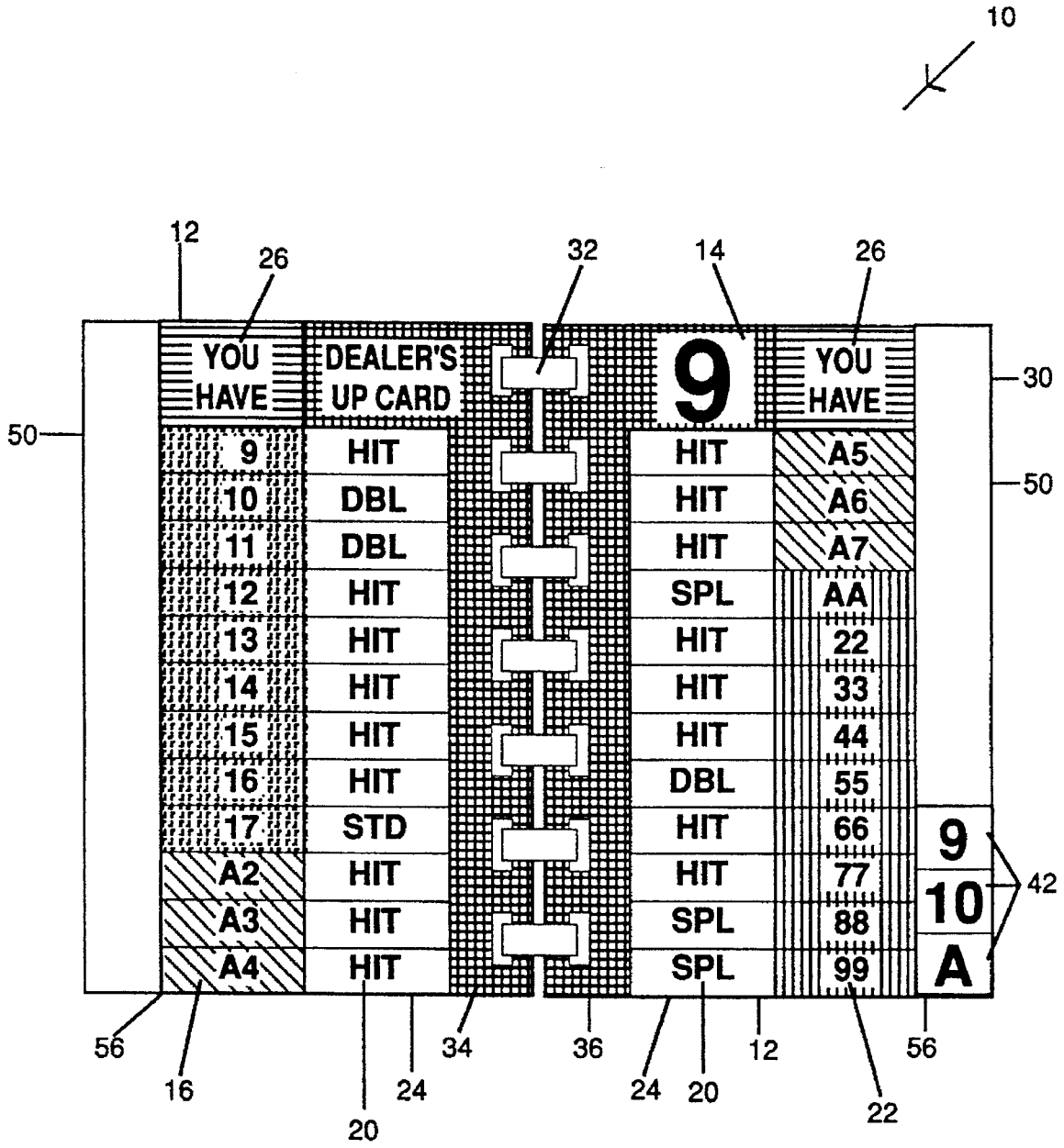
Figure 1H:
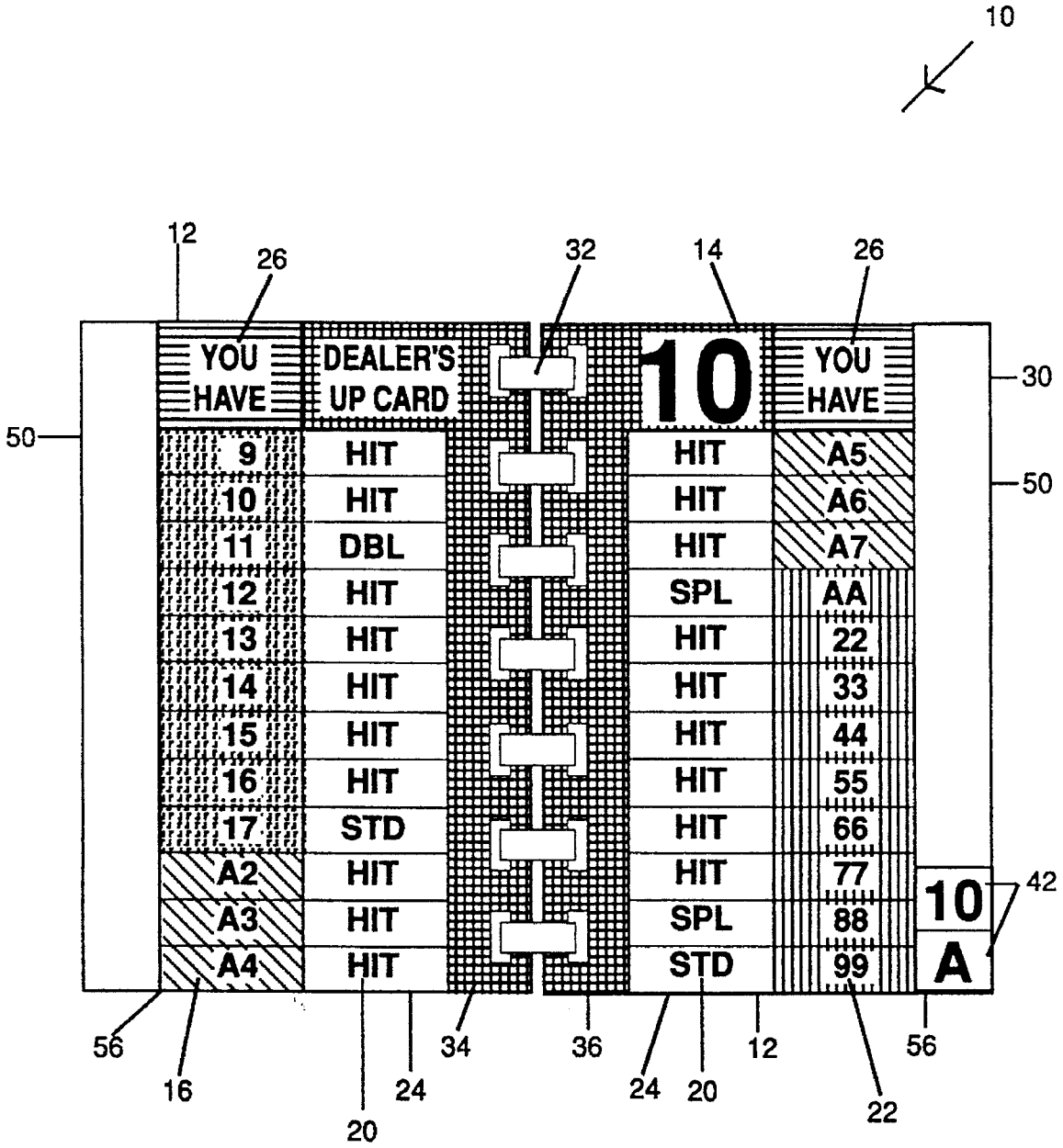
Figure 1I:
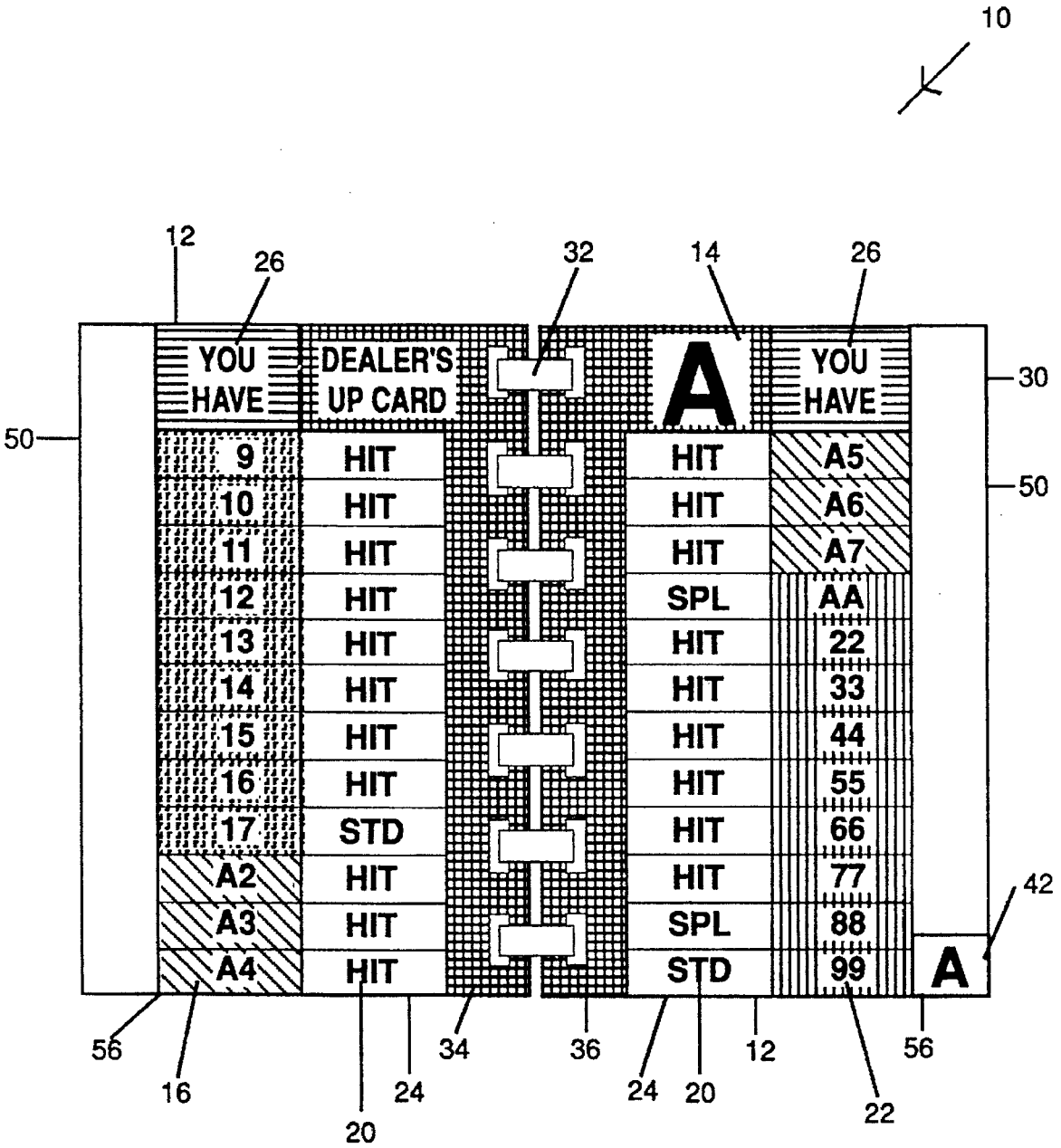

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1*a*–1*i*, a play recommendation apparatus 10 is disclosed for assisting a player in the game of blackjack. Apparatus 10 preferably includes a sheet 12 having printed on it a dealer up card symbol 14 identifying a possible dealer up card and a player hand column 16 of player hand symbols 22 corresponding to possible player card hands. Juxtaposed beside player hand column 16 is a play column 24 containing play symbols 20 for the recommended play for the player to make corresponding to each player hand symbol 22 in player hand column 16, given the value of the dealer up card indicated on the sheet 12. Player hand column 16 preferably includes a column heading 26 such as "You Have".

Figure 2:
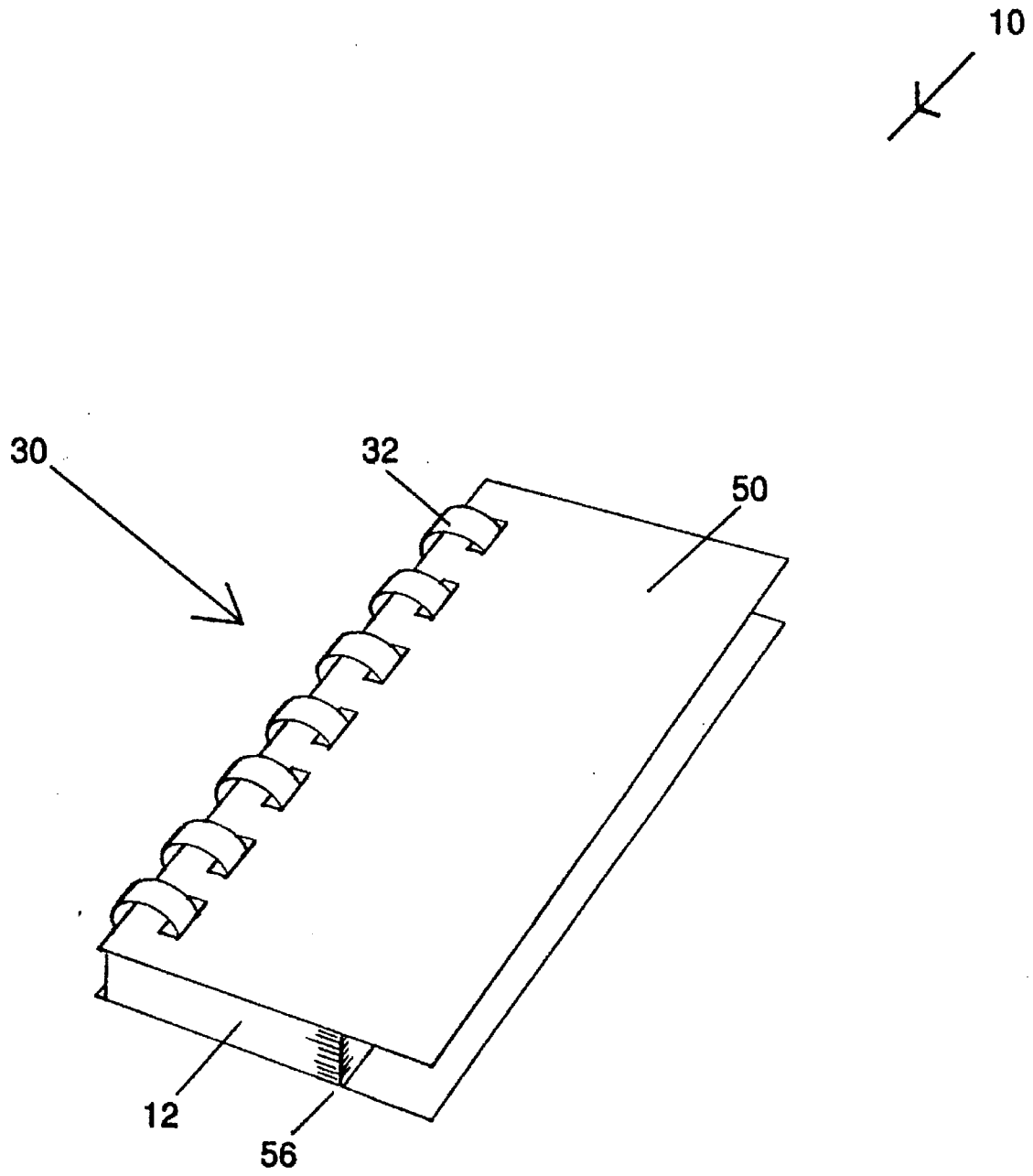
FIG. 2 is a perspective view of the inventive play recommendation book.
Figure 3:
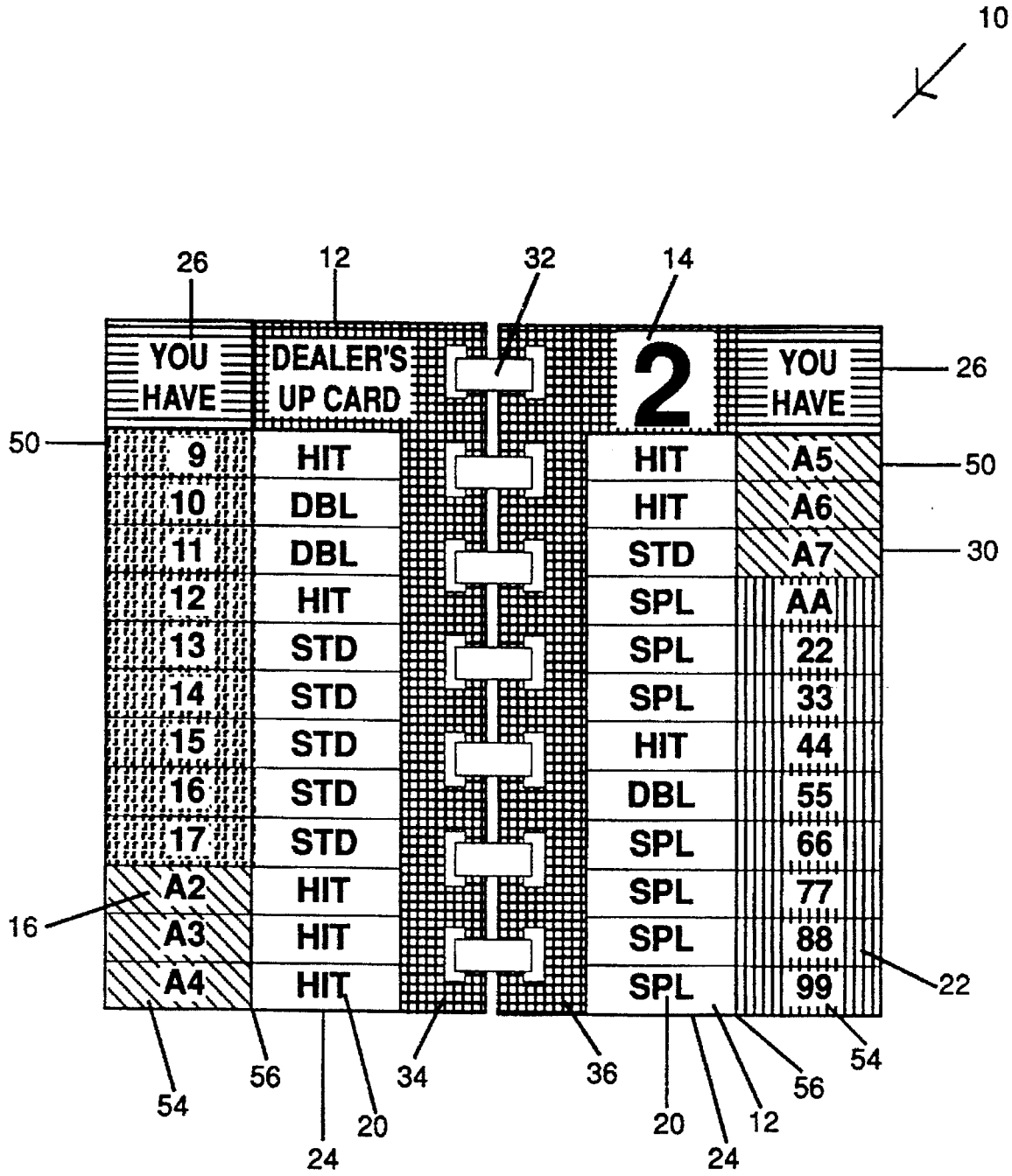
FIGS. 3 and 3*a*–3*i* are examples of the inventive sheets and cover of the second embodiment making up a play recommendation book.
Figure 3A:
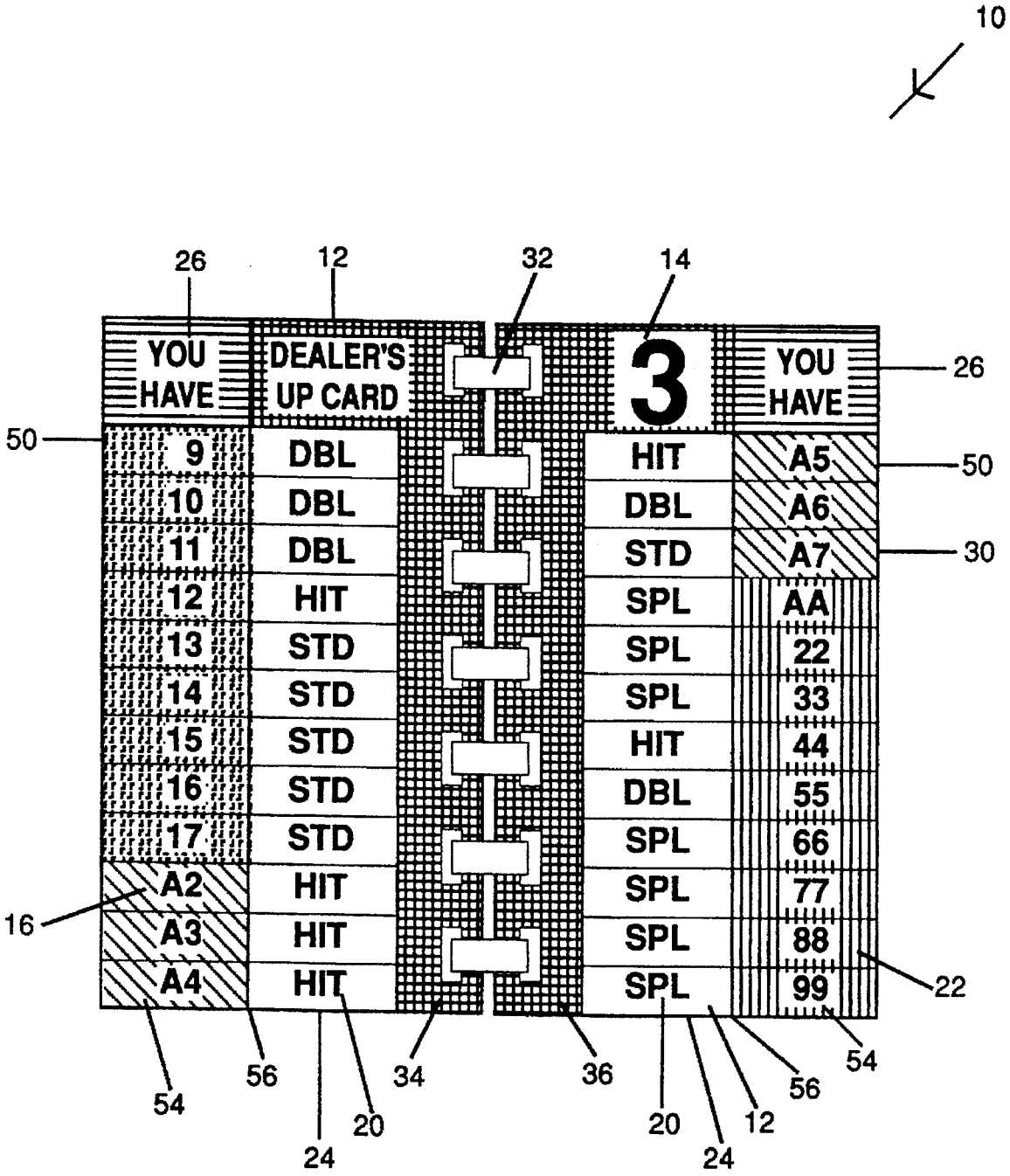
Figure 3B:
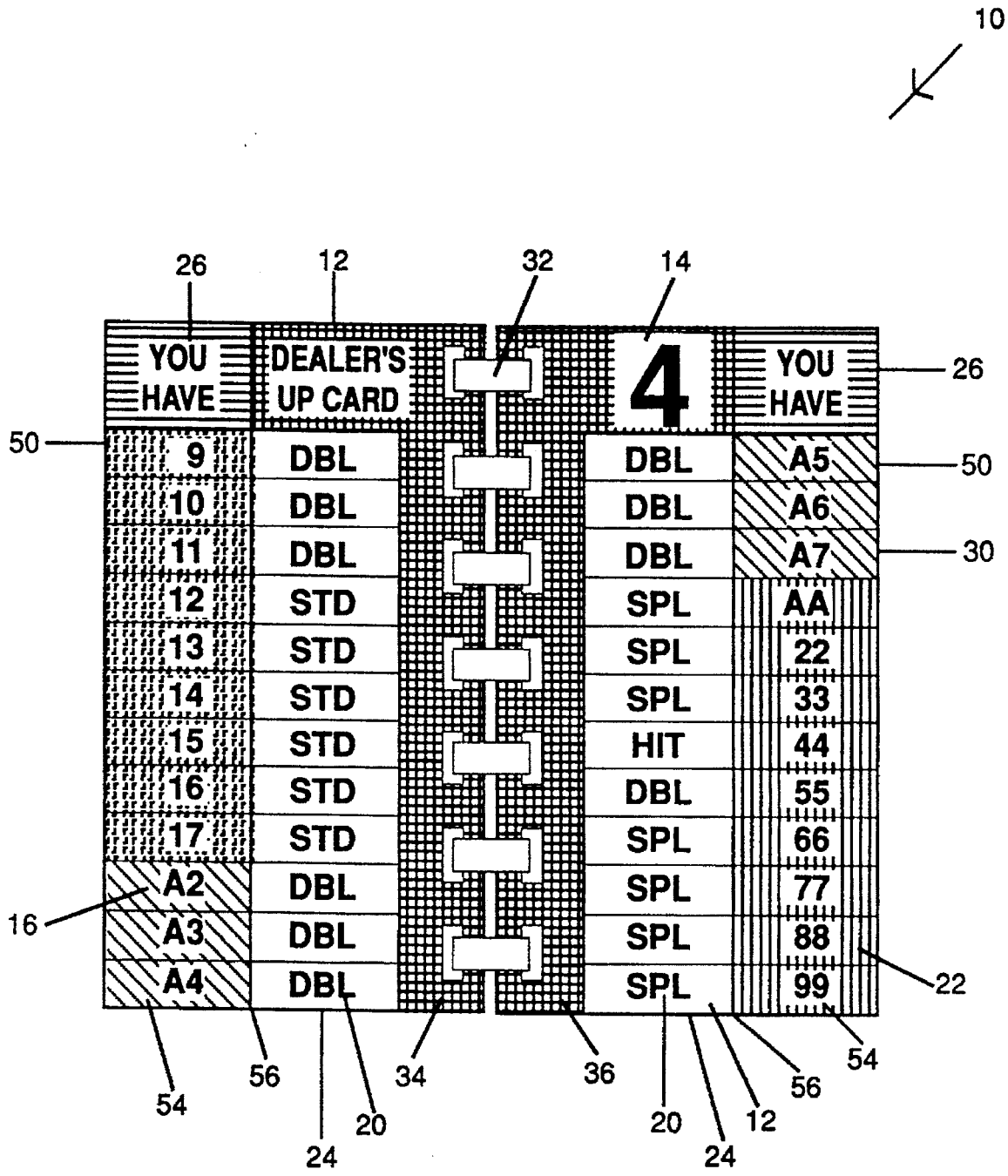
Figure 3C:
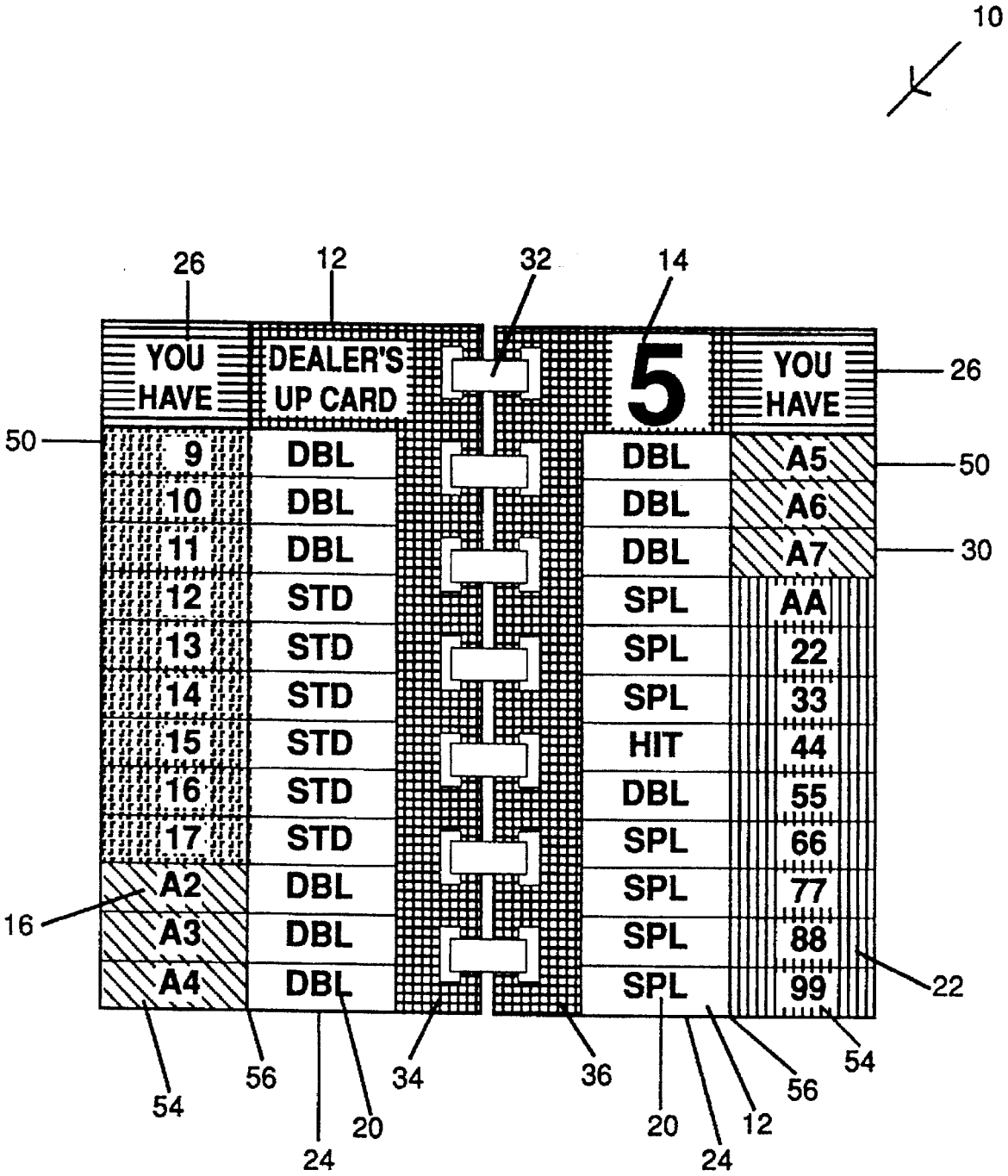
Figure 3D:
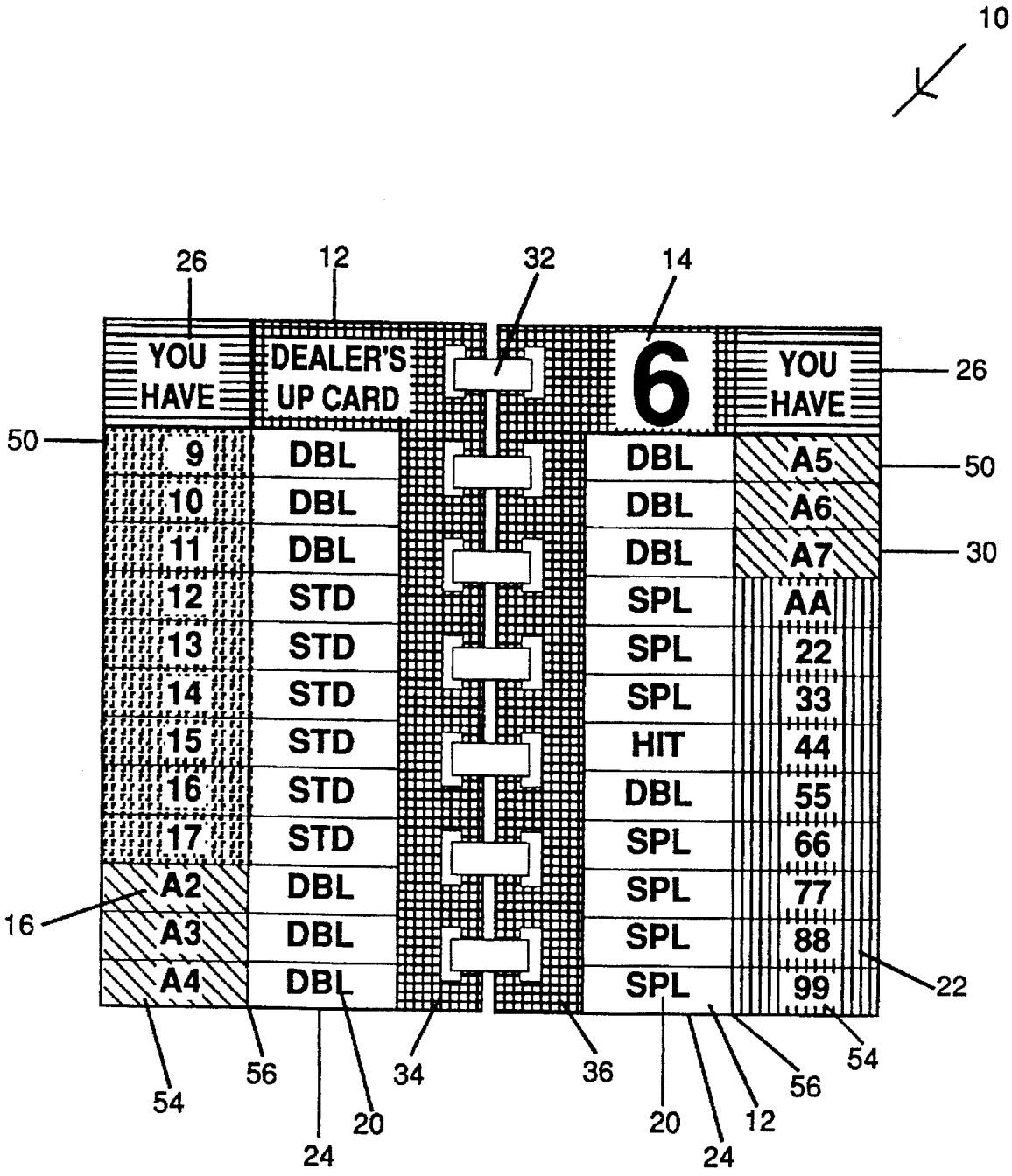
Figure 3E:
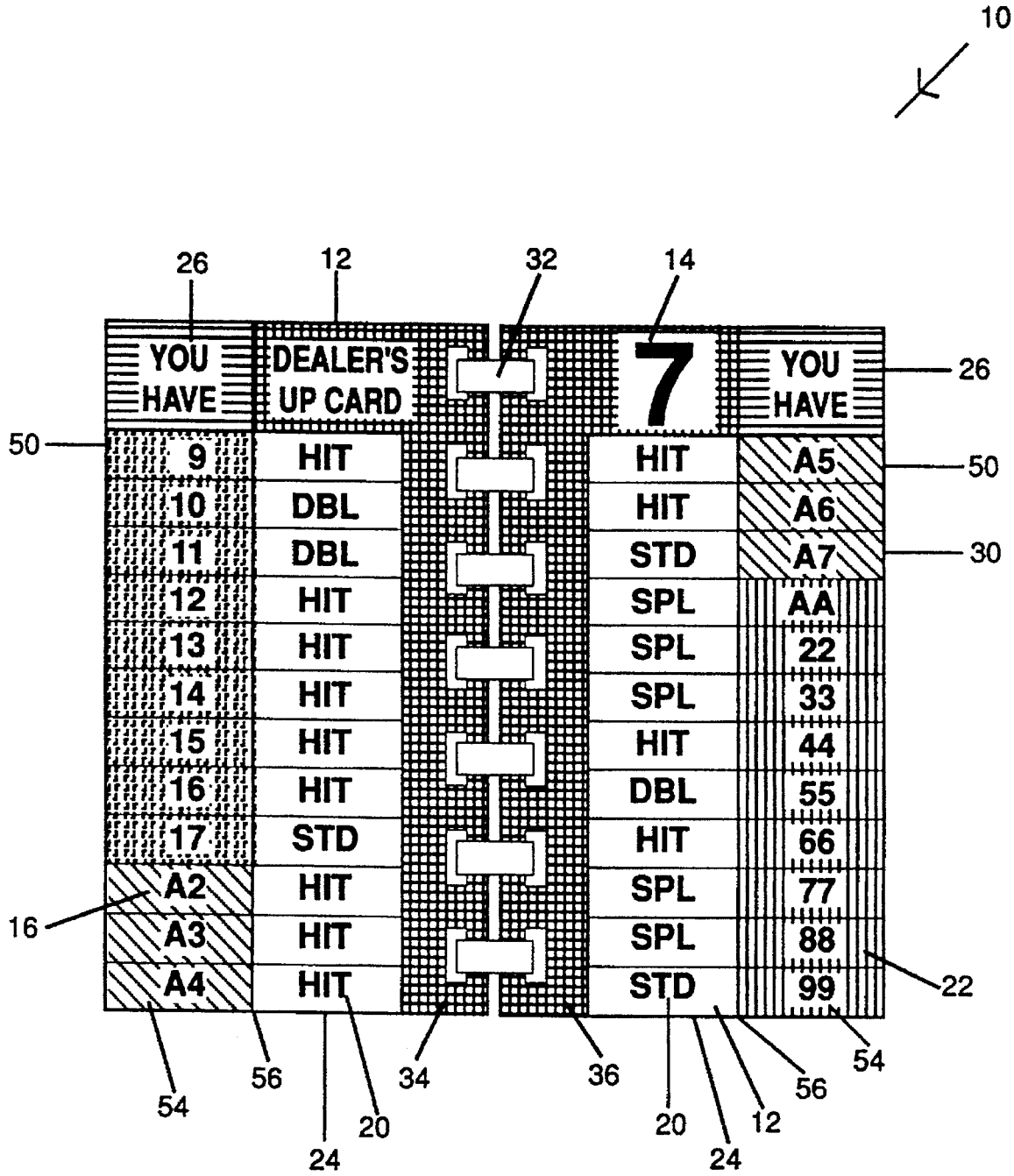
Figure 3F:
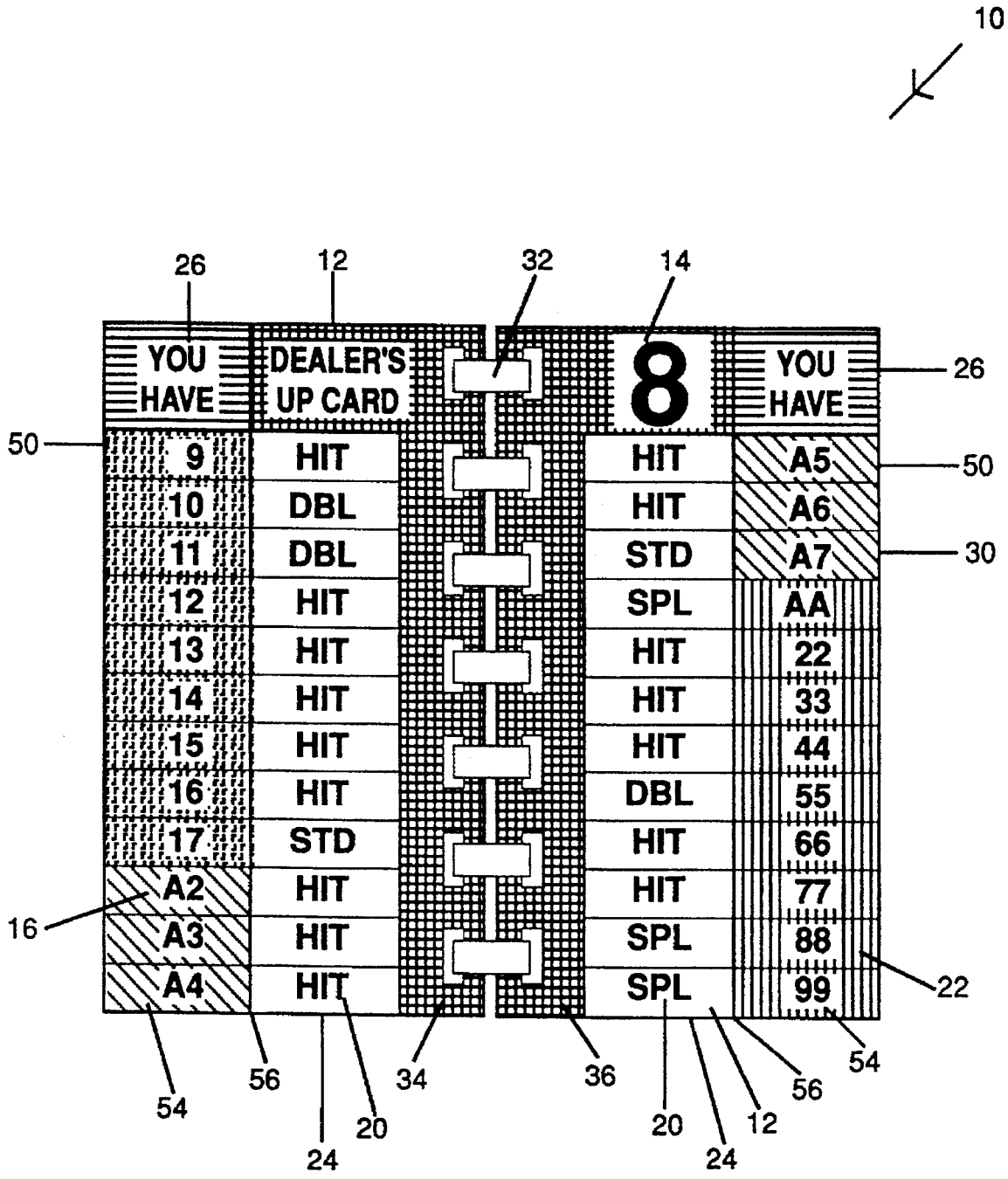
Figure 3G:
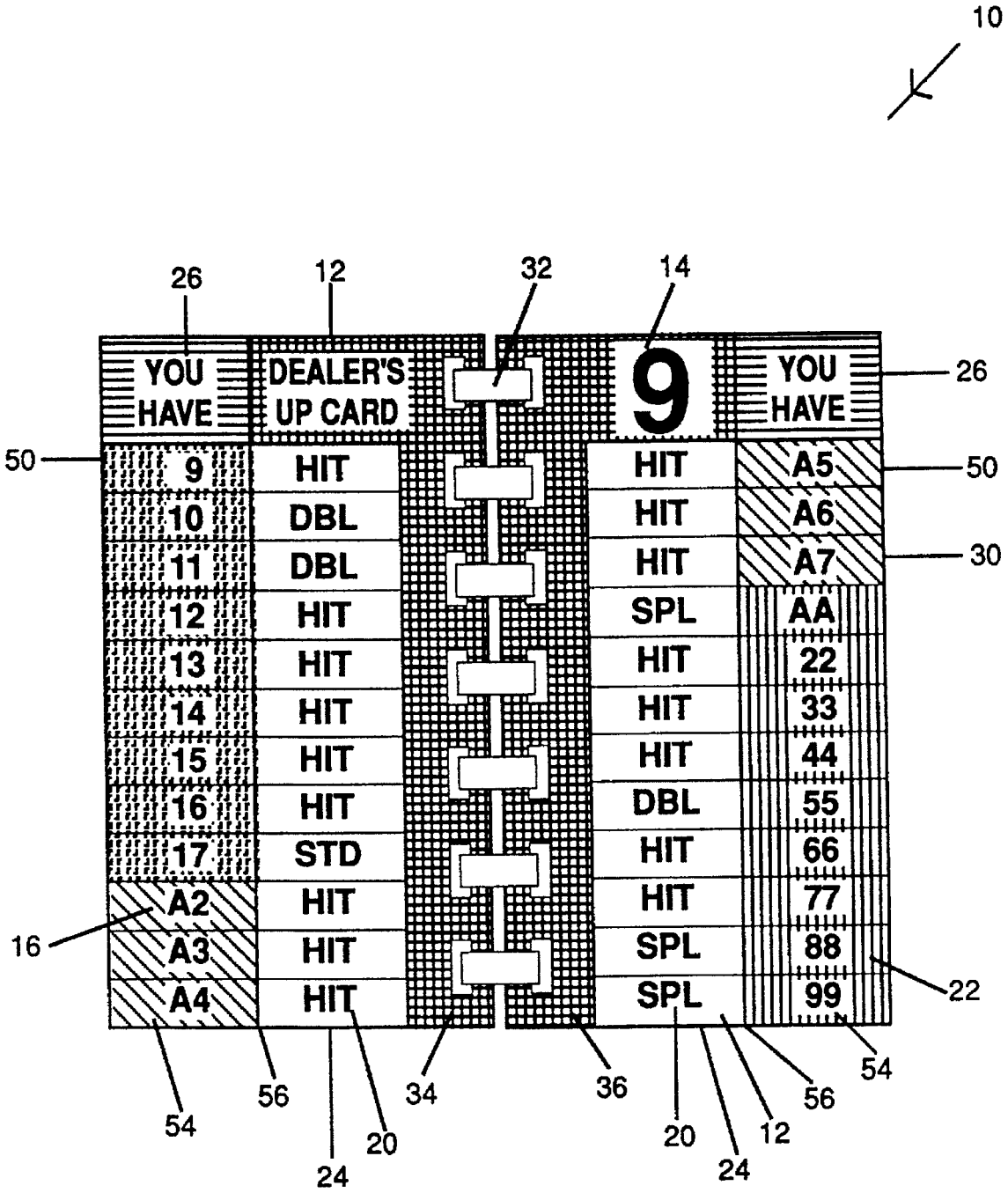
Figure 3H:
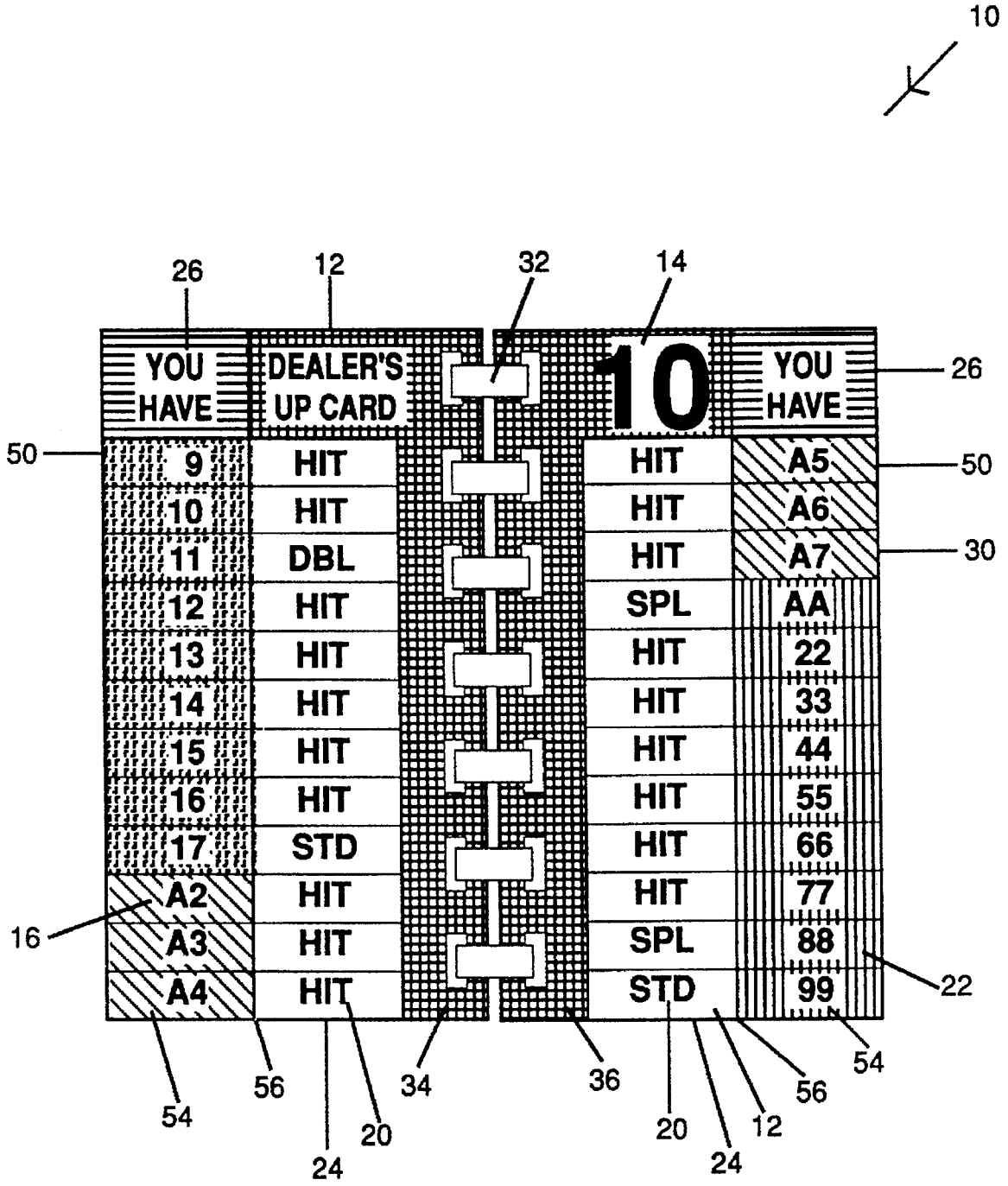
Figure 3I:
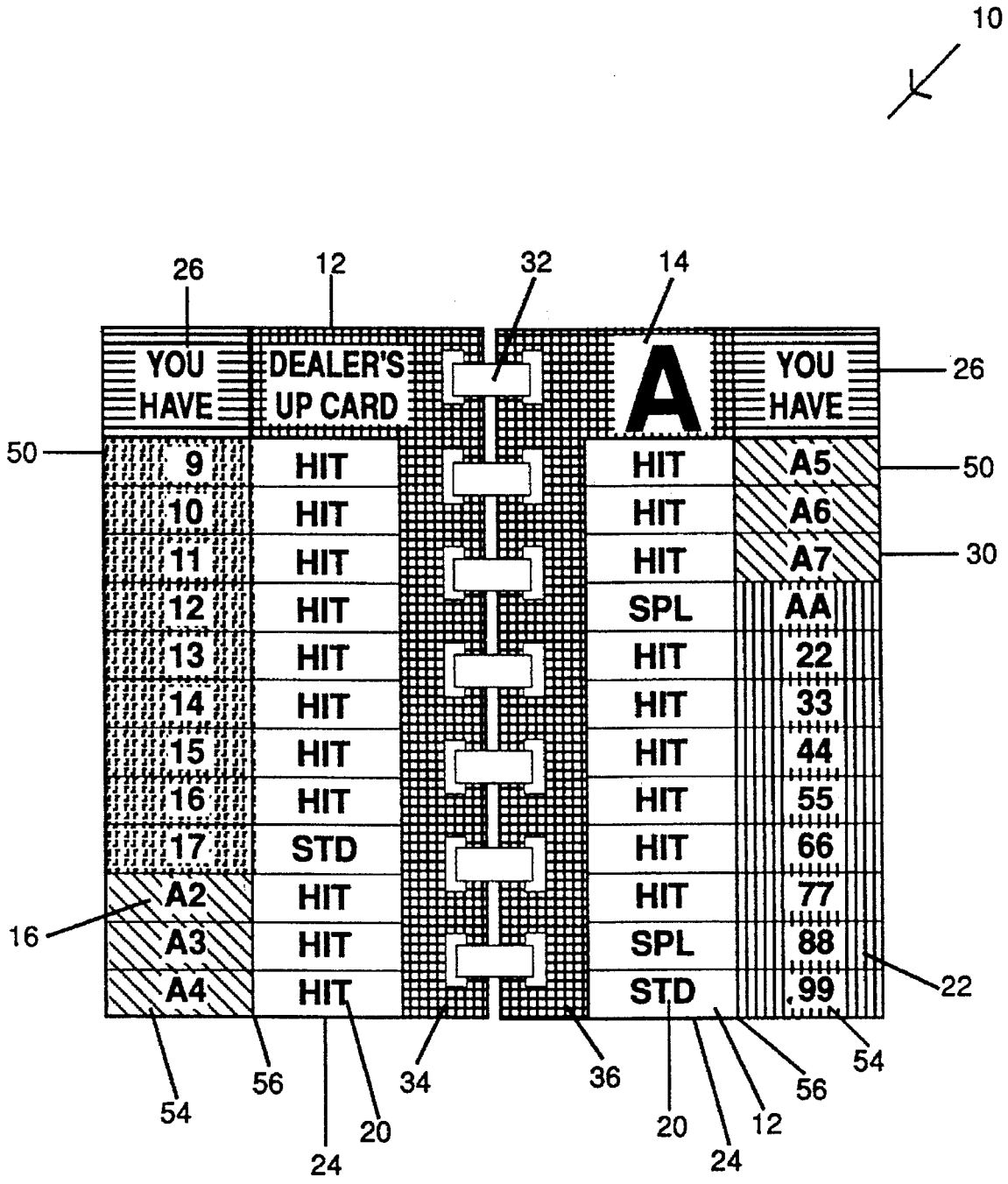

Several sheets 12 are preferably provided, one for a each of several possible dealer up cards, and are bound together in dealer up card numerical sequence into a conveniently sized book 30. See FIG. 2. Generalized data about any remaining up card values may be printed on a special page in book 30. Book 30 preferably has a spiral binder 32 so that book 30 opens with minimal resistance to any selected sheet 12 and stays open without being held. Each sheet 12 is preferably divided into sheet halves 34 and 36 separated by binder 32, so that half of each column 16 and 24 extends vertically down one sheet half 34 and the other half of each column 16 and 24 extends down the facing sheet half 36. The backs of sheets 12 are preferably the fronts of other sheets 12 for book 30 compactness and efficiency. Player hand symbols 22 in column 16 are preferably in player card value numerical order and color coded in blocks, so that hard hands are one color, soft hands another color, and doubles still another color for rapid and convenient access to play information. A tab 42 preferably extends from each sheet 12, each tab 42 displaying the same dealer up card symbol 14 marked on the particular sheet 12 from which it extends.

The recommended plays displayed in play column 24 are preferably based upon maximized statistics of success for the player. The recommended plays alternatively may be based upon personal experience or other factors.

Second Preferred Embodiment

Alternatively the sheets 12 may include only the single dealer up card symbol 14 and play column 24. See FIGS. 3*a*–3*i*. Book 30 includes a cover 50 or lighter weight hand column back sheets. Since player hand column 16 is normally constant from sheet 12 to sheet 12, it is printed only on portions 52 of book cover 50 or the hand column back sheets inner surfaces 54 extending beyond the free sheet 12 edges 56 to align and correspond with adjacent recommended play symbols 20 on each and every open sheet 12.

System

In practicing the invention, the following method may be used. The player notes the value of the dealer up card and opens book 30 to the sheet 12 displaying the corresponding up card symbol 14. Then the player notes the value of his or her own hand and locates the player hand symbol 22 in column 16 corresponding to this value. The player notes the play symbol 20 directly and immediately adjacent the given hand symbol 22 and hits, stands, doubles or splits accordingly.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A compact handheld book apparatus for recommending plays fast and accurately during the game of blackjack, comprising:

a plurality of sheets each sheet having a sheet first face and a sheet second face, an enlarged dealer up card symbol printed on top of said sheet identifying a possible dealer up card, a vertical player hand column of player hand symbols printed on said sheet first face corresponding to possible player card hands, a recommended vertical play column printed on said sheet first face beside said player hand column and containing symbols indicating recommended plays for a player to make corresponding to each said player hand symbol in said player hand column for the particular dealer up card printed on said sheet, each of said sheets are arranged in sequential order of dealer up card values indicated by said dealer up card symbols, a tab extending sideways from each said sheet, each said tab displaying the given dealer up card symbol marked on the particular said sheet from which the given said tab extends, each of the tabs being readable and accessible when the sheets are in a closed position, a sheet binding edge having perforations and a sheet opposing free edge for each sheet, and a spiral binder means which engages said sheet binding edges to thereby retain said sheets together in the form of a book, wherein a player can select plays from the tab and the sheet corresponding to the dealer up card symbol fast and accurately during the game of blackjack.

2. The compact handheld book apparatus of claim 1, wherein said sheets are each divided into first and second sheet halves, forming pairs of sheet halves, each said pair of sheet halves being connected by said binder means such that said book opens to display first faces of only one said pair of sheet halves at a time.

3. The compact handheld book apparatus of claim 2, wherein said play column of a given said sheet is divided into first and second play column segments, said first play column segment being printed on the sheet first face of said first sheet half of the given pair of sheet halves, and said second play column segment being printed on the sheet first face said second sheet half, such that the entire said play column is displayed when said book is opened to the given said sheet.

4. The compact handheld book apparatus of claim 2, wherein said dealer up card symbols are printed on said sheet first faces and wherein said sheet second faces are printed to become sheet first faces of other said sheets, for increased book compactness.

5. The compact handheld book apparatus of claim 1, wherein said player hand column is color coded, so that hard hands are represented in a first color, soft hands are represented in a second color, and identical card hands are represented in a third color, for rapid and convenient access to recommended play information.

6. A compact handheld book apparatus for recommending plays fast and accurately during the game of blackjack, comprising:

a cover member having an inner surface and an outer surface, a plurality of sheets, each having a sheet first face and a sheet second face, a binder securing said cover member and said sheets together, an enlarged up card symbol printed on top of each said sheet identifying a possible dealer up card, said up card symbol and dealer up card identified by said up card symbol varying from sheet to sheet, a vertical recommended play column printed on each said sheet and containing recommended play symbols for a player to make, a vertical player hand column of player hand symbols printed on a portion of said cover member inner surface and extending beyond said sheets, beside said player hand column printed on each said sheet, said play hand symbols corresponding to and substantially aligning with individual said play symbols in said play column on each said sheet for the particular dealer up card printed on each said sheet, wherein said dealer up card symbols are printed on said sheet first faces and wherein said sheet second faces are printed to become sheet first faces of other said sheets, for increased book compactness, a tab extending sideways from each said sheet, each said tab displaying the given dealer up card symbol marked on the particular said sheet from which the given said tab extends, each of the tabs being readable and accessible when the sheets are in a closed position, and color coding each of said sheets, so that hard hands are represented in a first color, soft hands are represented in a second color, and identical card hands are represented in a third color, for rapid and convenient access to recommended play information, wherein a player can select plays by picking the tab and the sheet corresponding to the dealer up card symbol fast and accurately during the game of blackjack.

* * * * *